US011227571B2

(12) United States Patent
Tanoue

(10) Patent No.: US 11,227,571 B2
(45) Date of Patent: Jan. 18, 2022

(54) SWITCHING DEVICE FOR ELECTRONIC MUSICAL INSTRUMENT

(71) Applicant: YAMAHA CORPORATION, Hamamatsu (JP)

(72) Inventor: Michiko Tanoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/567,460

(22) Filed: Sep. 11, 2019

(65) Prior Publication Data

US 2020/0005751 A1 Jan. 2, 2020

Related U.S. Application Data

(63) Continuation of application No. PCT/JP2018/007480, filed on Feb. 28, 2018.

(30) Foreign Application Priority Data

Mar. 24, 2017 (JP) ..... JP2017-060142

(51) Int. Cl.
*G10H 1/34* (2006.01)

(52) U.S. Cl.
CPC ..... *G10H 1/346* (2013.01); *G10H 2220/221* (2013.01)

(58) Field of Classification Search
CPC . G10H 1/346; G10H 2220/221; G10H 1/3462
(Continued)

(56) References Cited

U.S. PATENT DOCUMENTS 4,186,638 A * 2/1980 Iijima ..... G10H 1/344 84/655
4,272,657 A * 6/1981 Iijima ..... H01H 13/702 200/5 A (Continued)

FOREIGN PATENT DOCUMENTS

JP S59147194 U 10/1984
JP S61253726 A 11/1986

(Continued)

OTHER PUBLICATIONS

International Search Report issued in Intl. Appln. No. PCT/JP2018/007480 dated Apr. 24, 2018. English translation provided.

(Continued)

*Primary Examiner* — Christina M Schreiber
(74) *Attorney, Agent, or Firm* — Rossi, Kimms & McDowell LLP

(57) ABSTRACT

Provided is a switching device for an electronic musical instrument, comprising: a plurality of first electrodes that are adjacently arranged; a second electrode arranged between a pair of the plurality of first electrodes, and insulated from the plurality of first electrodes by a plurality of spaces; a rotatable actuator; and a conductive member configured to electrically connect the first electrodes and the second electrode according to rotation of the actuator. The plurality of spaces extend longitudinally in a first direction. The first direction is a direction between a rotational shaft direction of the actuator and a direction orthogonal to the rotational shaft direction.

19 Claims, 20 Drawing Sheets

(58) Field of Classification Search
USPC ..... 84/644
See application file for complete search history.

(56) References Cited

U.S. PATENT DOCUMENTS

| | | | | | |
|---|---|---|---|---|---|
| 4,628,785 | A * | 12/1986 | Buchla | G10H 1/344 | 200/5 A |
| 4,933,807 | A * | 6/1990 | Duncan | G10H 1/0551 | 361/283.2 |
| 5,247,129 | A * | 9/1993 | Nozaki | G10H 1/055 | 84/192 |
| 5,278,557 | A * | 1/1994 | Stokes | G06F 3/0338 | 200/520 |
| 5,495,074 | A * | 2/1996 | Kondo | G10H 1/344 | 84/690 |
| 6,392,174 | B1 * | 5/2002 | Gotoh | H05K 1/02 | 174/261 |
| 2017/0168575 | A1 * | 6/2017 | Kasahara | G06F 1/1652 | |
| 2018/0286605 | A1 * | 10/2018 | Tanoue | G10H 1/344 | |
| 2020/0005751 | A1 * | 1/2020 | Tanoue | G10H 1/346 | |
| 2020/0013381 | A1 * | 1/2020 | Yamamoto | G10C 3/18 | |

FOREIGN PATENT DOCUMENTS

| | | | |
|---|---|---|---|
| JP | S6434721 | U | 3/1989 |
| JP | H0485538 | U | 7/1992 |
| JP | H0580763 | A | 4/1993 |
| JP | H11213815 | A | 8/1999 |
| JP | 2000048660 | A | 2/2000 |
| JP | 2000322962 | A | 11/2000 |
| JP | 2001210179 | A | 8/2001 |
| JP | 2004226687 | A | 8/2004 |

OTHER PUBLICATIONS

Written Opinion issued in Intl. Appln. No. PCT/JP2018/007480 dated Apr. 24, 2018.
Office Action issued in Japanese Appln. No. 2017-060142 dated Dec. 8, 2020. English machine translation provided.
Notice of Reasons for Refusal issued in Japanese Appln. No. 2017-060142 dated Jun. 22, 2021. English machine translation provided.

* cited by examiner

Prior Art

SWITCHING DEVICE FOR ELECTRONIC MUSICAL INSTRUMENT

CROSS REFERENCE TO RELATED APPLICATIONS

The present application is a continuation application of International Application No. PCT/JP2018/7480, filed Feb. 28, 2018, which claims a priority to Japanese Patent Application No. 2017-60142, filed Mar. 24, 2017. The contents of these applications are incorporated herein by reference in their entirety.

FIELD OF INVENTION

The present invention relates to a switching device for an electronic musical instrument and a switching device for a keyboard device.

BACKGROUND

In an acoustic piano, an action mechanism operates to convey a predetermined feeling (hereinafter referred to as a touch feeling) to a player's finger through a key. In the acoustic piano, the action mechanism is required to press a key with a hammer. On the other hand, in an electronic keyboard instrument, key pressing is detected by a sensor, so it is possible to generate sound without having an action mechanism like that in an acoustic piano. The touch feeling of an electronic keyboard musical instrument that does not use an action mechanism, or an electronic keyboard musical instrument that uses a simple action mechanism, feels very different from the touch feeling of an acoustic piano. Therefore, technology has been disclosed in which, in an electronic keyboard musical instrument, a mechanism corresponding to a hammer in an acoustic piano is provided in order to obtain a touch feeling that is even slightly close to the touch feeling of an acoustic piano (for example, see JP 2004-226687A).

SUMMARY OF THE INVENTION

In the above technology, sound is generated by the hammer moving according to a key pressing operation by the player to press the sensor. In this case, it is sufficient that force is always applied in the direction perpendicular to the key, but in a case where the key is far away from the player, or when the key is strongly pressed, force is not necessarily applied only in the perpendicular direction, and in some cases the application of force is shifted in a scale direction (a lateral direction) in which keys are arranged, or in a longitudinal direction (vertical direction) of the key. In such a case, the sensor does not operate stably, and there is a risk that a sound generation defect may occur. Further, in a keyboard device in which a hammer does not press a sensor (or a keyboard device in which a hammer is not used), there is a risk that the above-described problem will occur even in a case where a key directly presses a sensor, so this sound generation defect easily occurs. Further, there is a risk that the above-described problem will occur also in other electronic musical instruments.

One object of the present invention is to enable a player to stably generate sound from an electronic musical instrument.

According to one embodiment of the present invention, there is provided a switching device for an electronic musical instrument. The switching device includes: a plurality of first electrodes that are adjacently arranged; a second electrode arranged between a pair of the plurality of first electrodes, and insulated from the plurality of first electrodes by a plurality of spaces; a rotatable actuator; and a conductive member that electrically connects the first electrodes and the second electrode according to operation of the actuator. Here, the plurality of spaces extend longitudinally in a first direction, and the first direction is a direction between a rotational shaft direction of the actuator and a direction orthogonal to the rotational shaft direction.

In the above-described switching device for the electronic musical instrument, the first direction may be inclined 10° to 80° relative to the direction orthogonal to the rotational shaft direction.

According to one embodiment of the present invention, there is provided a switching device for a keyboard device. The switching device includes the above-described switching device for the electronic musical instrument, and keys. Here, the actuator operates according to operation of the keys.

In the above-described switching device for the keyboard device, the actuator may extend longitudinally in the direction orthogonal to the rotational shaft direction.

In the above-described switching device for the keyboard device, the first direction may differ depending on the key.

In the above-described switching device for the keyboard device, the first direction may differ depending on the pitch of sound generated by pressing the key.

In the above-described switching device for the keyboard device, the first direction may differ depending on the shape of the key.

According to one embodiment of the present invention, there is provided a switching device for a keyboard device. The switching device includes: keys; a plurality of first electrodes that are adjacently arranged; a second electrode arranged between a pair of the plurality of first electrodes, and insulated from the plurality of first electrodes by a plurality of spaces; an actuator that operates according to key pressing; and a conductive member that electrically connects the first electrodes and the second electrode according to operation of the actuator. Here, the plurality of spaces extend longitudinally in a first direction, and the first direction is a direction between a scale direction of the actuator and a longitudinal direction of the keys.

In the above-described switching device for the keyboard device, the first direction may be inclined 10° to 80° relative to the longitudinal direction of the keys.

According to one embodiment of the present invention, there is provided a swtiching device for an electronic musical instrument. The switching device includes: a plurality of first electrodes that are adjacently arranged; a second electrode arranged between a pair of the plurality of first electrodes, and insulated from the plurality of first electrodes by a plurality of spaces; a rotatable actuator; and a conductive member that electrically connects the first electrodes and the second electrode according to rotation of the actuator. Here, the plurality of spaces extend longitudinally in a first direction, the actuator has a flexible portion and a tip portion arranged facing the flexible portion, the tip portion operates using the flexible portion as a shaft, and the first direction is a direction between a second direction that joins the flexible portion and the tip portion, and a third direction orthogonal to the second direction.

In the above-described switching device for the electronic musical instrument, the first direction may be inclined 10° to 80° relative to the second direction.

According to the present invention, it is possible to enable a player to stably generate sound from an electronic musical instrument.

DETAILED DESCRIPTION OF THE PREFERRED EMBODIMENTS

Figure 1:
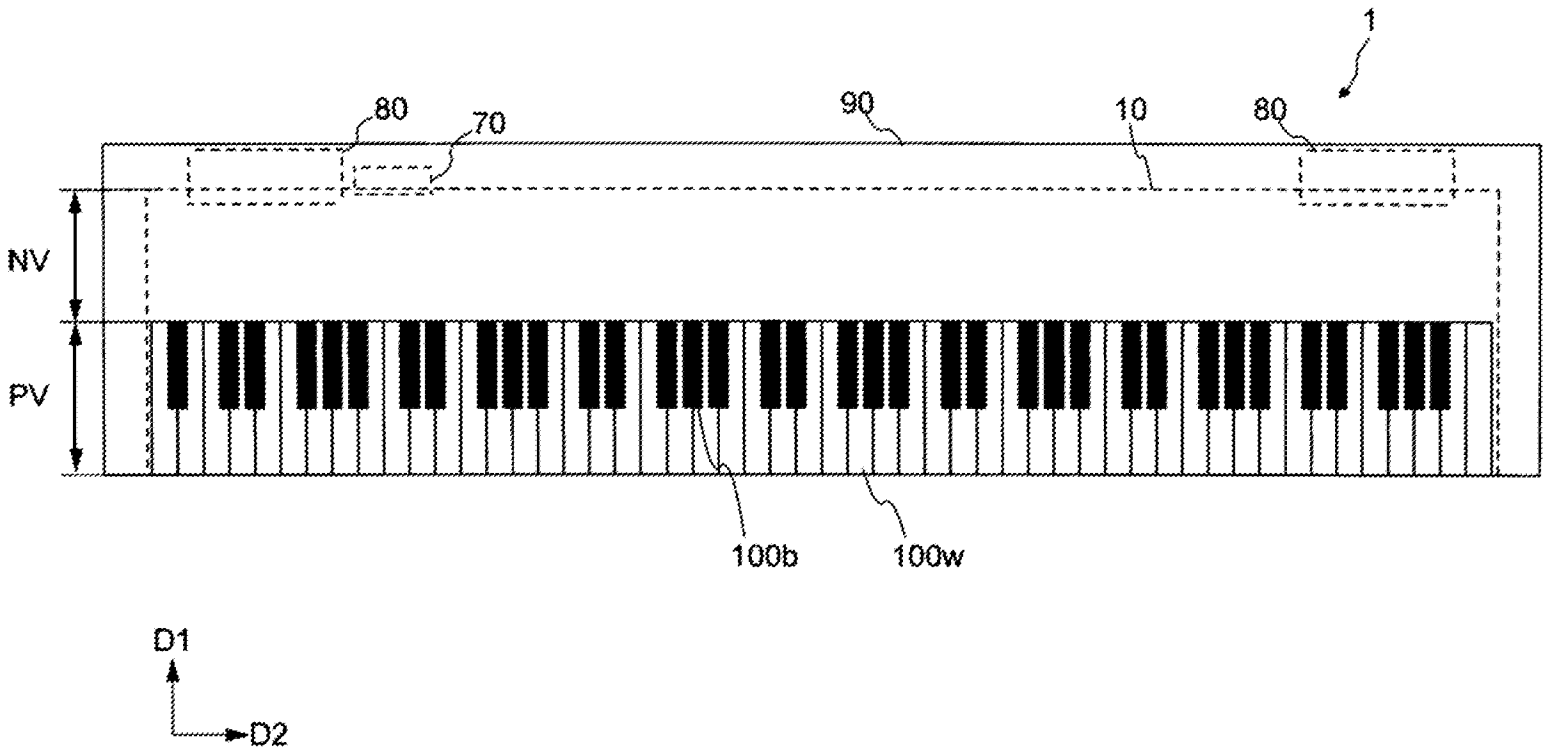
FIG. 1 shows the configuration of a keyboard device in a first embodiment.

Hereinafter, a keyboard device in one embodiment of the present invention will be described in detail with reference to the drawings. The embodiment disclosed below is an example of an embodiment of the present invention, and the present invention is not to be interpreted as limited by this embodiment. In the drawings referred to in the present embodiment, the same portions or portions having similar functions are denoted by the same reference numerals or similar reference numerals (reference numerals with only a, b, or the like appended after numerals), and repeated description of such portions may be omitted. Also, dimensional ratios (ratios between configurations, ratios between vertical and horizontal directions, or the like) in the drawings may differ from actual ratios for convenience of a description, and some configurations may be omitted from the drawings.

First Embodiment

1-1. Configuration of Keyboard Device

FIG. 1 shows the configuration of a keyboard device in a first embodiment. In this example, a keyboard device 1 is an electronic keyboard musical instrument such as an electronic piano that generates sound according to key pressing by a user (a player). Note that the keyboard device 1 may also be a keyboard-type controller that outputs control data (for example, MIDI) for controlling an external sound source device according to key pressing. In this case, the keyboard device 1 may not be provided with a sound source device.

The keyboard device 1 includes a keyboard assembly 10. The keyboard assembly 10 includes white keys 100*w* and black keys 100*b*. A plurality of the white keys 100*w* and the black keys 100*b* are arranged side by side. The number of keys 100 is N, which is 88 in this example. The direction in which the keys 100 are arranged is referred to as a scale direction (or may be referred to as a direction D2). When the white keys 100*w* and the black keys 100*b* can be described without particularly distinguishing them, they may be referred to as the keys 100. In the following description as well, when "w" is appended to the end of a reference numeral, this means that the configuration corresponds to a white key. Further, when "b" is added to the end of a reference numeral, this means that the configuration corresponds to a black key. Also, a longitudinal direction of the keys 100 may be referred to as a direction D1.

Part of the keyboard assembly 10 exists inside a case 90. When the keyboard device 1 is viewed from above, a portion of the keyboard assembly 10 covered by the case 90 is referred to as a non-visible portion NV, and a portion exposed from the case 90 and visible to the user is referred to as a visible portion PV. That is, the visible portion PV includes part of the keys 100 and indicates an area where the user can perform a musical performance playing operation. Hereinafter, the portion of the keys 100 exposed by the visible portion PV may also be referred to as a key main body.

A sound source device 70 and a speaker 80 are arranged inside of the case 90. The sound source device 70 generates a sound waveform signal according to pressing of a key 100. The speaker 80 outputs the sound waveform signal generated in the sound source device 70 to an external space. Note that the keyboard device 1 may also be provided with a slider for controlling volume, a switch for switching timbre, a display that displays various information, and the like.

Note that in the description of this specification, directions such as up, down, left, right, front and rear indicate directions when the keyboard device 1 is viewed from the player when playing. Therefore, for example, the non-visible portion NV can be said to be located on the rear side relative to the visible portion PV. Also, the direction may be indicated based on the keys 100, such as a key front end side (key front side) and a key rear end side (key rear side). In this case, the key front end side indicates the front side of the keys 100 as viewed from the player. The key rear end side indicates the rear side of the keys 100 as viewed from the player. According to this definition, it can be said that a portion from the front end to the rear end of the key main body of a black key 100*b* is a portion protruding upward from the white keys 100*w*.

Figure 2:
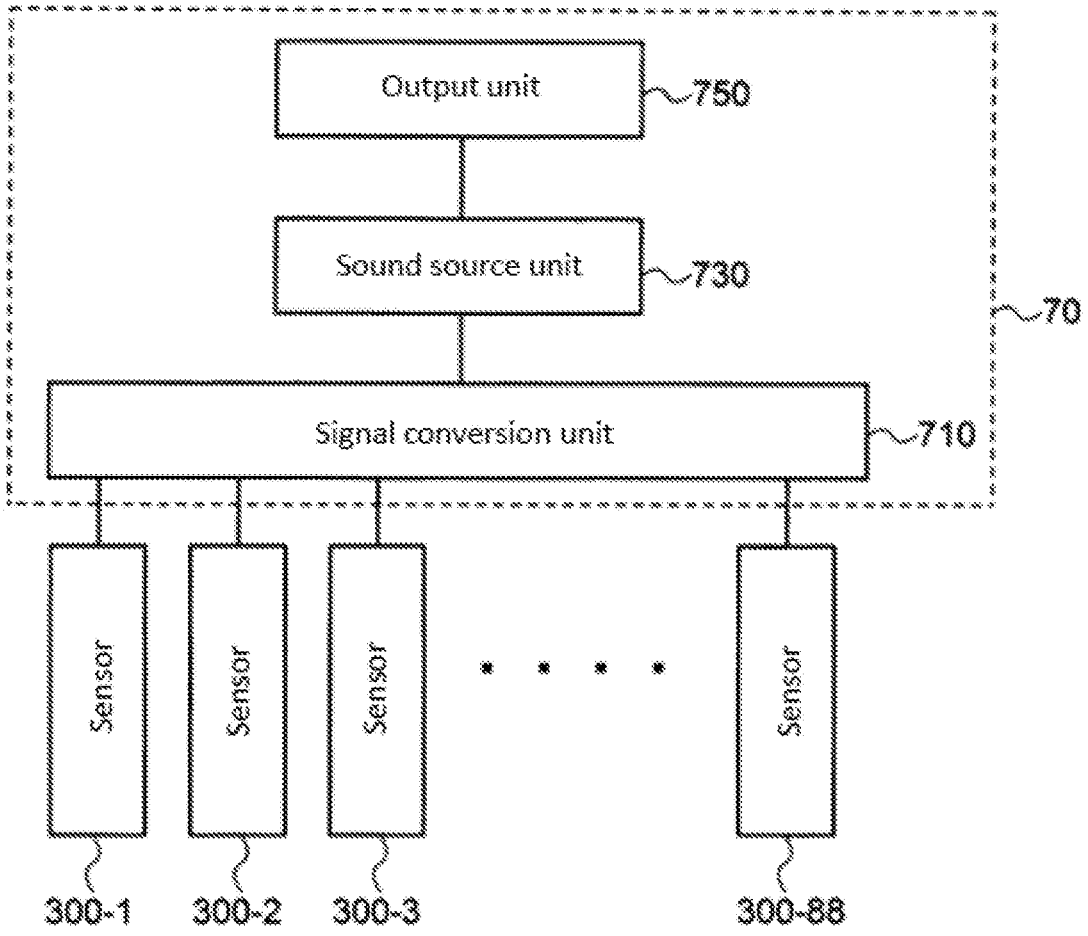
FIG. 2 is a block diagram that shows the configuration of a sound source device in the first embodiment.

FIG. 2 is a block diagram that shows the configuration of a sound source device in the first embodiment. The sound source device 70 includes a signal conversion unit 710, a sound source unit 730, and an output unit 750. A sensor 300 is provided corresponding to each key 100, detects operation of the corresponding key, and outputs a signal according to the detected content. In this example, the sensor 300 outputs a signal according to a three step key pressing amount. A key pressing speed can be detected according to an interval of this signal.

The signal conversion unit 710 obtains an output signal of the sensors 300 (sensors 300-1, 300-2, . . . , 300-88 corresponding to the 88 keys 100), generates an operation signal according to the operation state of each key 100, and outputs the operation signals. In this example, the operation signal is a signal in MIDI format. Therefore, according to the key pressing operation, the signal conversion unit 710 outputs a note-on signal. At this time, a key number indicating which of the 88 keys 100 was operated, and a velocity corresponding to the key pressing speed, are also output associated with the note-on signal. On the other hand, according to a key release operation, the signal conversion unit 710 outputs the key number and a note off signal associated with each other. A signal corresponding to another operation such as operation of a pedal may also be input to the signal conversion unit 710, and reflected in an operation signal.

The sound source unit 730 generates a sound waveform signal based on the operation signal output from the signal conversion unit 710. The output unit 750 outputs the sound waveform signal generated by the sound source unit 730. The sound waveform signal is output to the speaker 80 or a sound waveform signal output terminal, for example. The configuration of the keyboard assembly 10 will be described below.

1-2. Configuration of Keyboard Assembly

Figure 3:
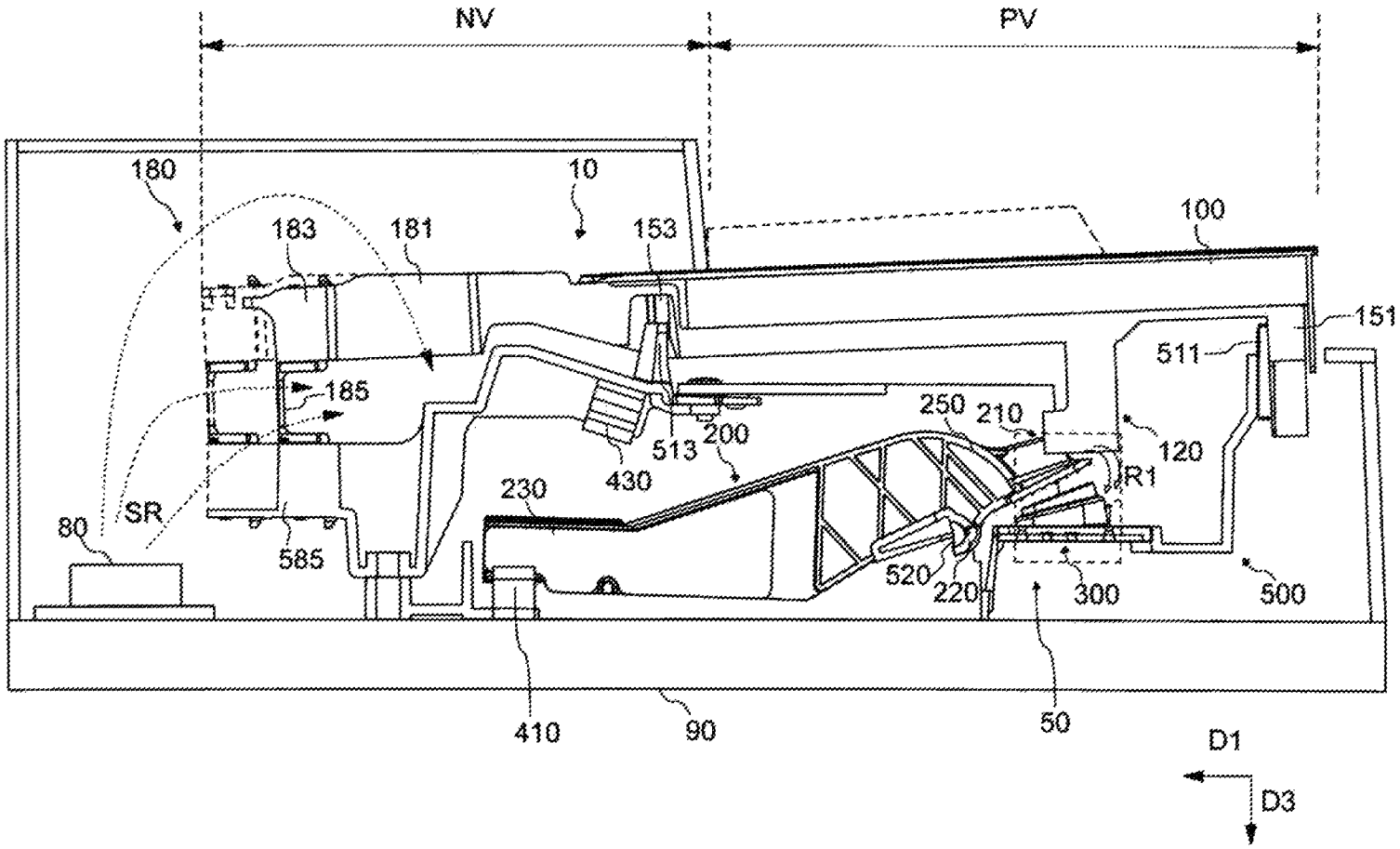
FIG. 3 is an explanatory view of the configuration inside a case in the first embodiment, viewed from a keyboard side face.

FIG. 3 is an explanatory view of the configuration inside the case in the first embodiment, viewed from the direction of a keyboard side face. As shown in FIG. 3, the keyboard assembly 10 and the speaker 80 are arranged inside the case 90. That is, the case 90 covers at least a portion (a connecting portion 180 and a frame 500) of the keyboard assembly 10 and the speaker 80. The speaker 80 is disposed at the rear side of the keyboard assembly 10. The speaker 80 is arranged so as to output a sound corresponding to key pressing toward the upper and lower sides of the case 90. The sound that is output downward travels from the lower face side of the case 90 to the outside. Note that a path of sound from the speaker 80 that reaches the space inside the keyboard assembly 10, that is, the space on the lower side of the key 100 (the key main body) is shown as a path SR, for example.

The keyboard assembly 10 includes the connecting portion 180, a hammer assembly 200, and the frame 500 in addition to the key 100 described above. The keyboard assembly 10 is a structure made of resin, mostly manufactured by injection molding or the like. The frame 500 is fixed to the case 90. The connecting portion 180 rotatably connects the key 100 to the frame 500. The connecting portion 180 includes a plate-like flexible member 181, a key side support portion 183, and a rod-like flexible member 185. The plate-like flexible member 181 extends from the rear end of the keys 100. The key side support portion 183 extends from the rear end of the plate-like flexible member 181. The rod-like flexible member 185 is supported by the key side support portion 183 and the frame side support portion 585 of the frame 500. That is, the rod-like flexible member 185 is arranged between the key 100 and the frame 500. Due to bending of the rod-like flexible member 185, the key 100 can rotate relative to the frame 500. The rod-like flexible member 185 is configured to be removable from the key side support portion 183 and the frame side support portion 585. Note that the rod-like flexible member 185 may be configured so as to not be removable, by being formed integrated with the key side support portion 183 and the frame side support portion 585, or by adhesion or the like.

The key 100 includes a front end key guide 151 and a side face key guide 153. The front end key guide 151 slidably contacts a front end frame guide 511 of the frame 500 in a state covering the front end frame guide 511. The front end key guide 151 is in contact with the upper and lower portions of the front end frame guide 511 on both sides in the scale direction. The side face key guide 153 slidably contacts a side face frame guide 513 on both sides in the scale direction. In this example, the side face key guide 153 is arranged in an area corresponding to the non-visible portion NV in the side face of the key 100, and exists on the key front end side relative to the connecting portion 180 (the plate-like flexible member 181), but the side face key guide 153 may also be arranged in an area corresponding to the visible portion PV.

Also, the key 100 is connected to a key side loading portion 120 below the visible portion PV. The key side loading portion 120 is connected to the hammer assembly 200 so as to allow the hammer assembly 200 to rotate when the key 100 rotates.

The hammer assembly 200 is arranged in a space below the key 100 and is rotatably attached to the frame 500. The hammer assembly 200 extends longitudinally in the front-rear direction (the direction D1) of the key. The hammer assembly 200 includes a weight portion 230 and a hammer body 250. The hammer main body 250 is provided with a shaft support portion 220 serving as a bearing for a rotational shaft 520 of the frame 500. The shaft support portion 220 and the rotational shaft 520 of the frame 500 slidably make contact at least three points.

A hammer side loading portion 210 is connected to a front end portion (also referred to as a tip portion) of the hammer main body 250. The hammer side loading portion 210 includes a portion that is slidable and contacts the inside of the key side loading portion 120 substantially in the front-rear direction. A lubricant such as grease may be arranged at this contact portion. The hammer side loading portion 210 and the key side loading portion 120 (in the following description, these may be collectively referred to as a "load generating portion") generate some of the load during key pressing by sliding against each other. The load generating portion is located below the key 100 in the visible portion PV (in front of the rear end of the key main body) in this example.

The weight portion 230 includes a metal weight, and is connected to the rear end portion (the rear side with respect to the rotational shaft) of the hammer main body 250. In a normal state (when the key is not pressed), the weight portion 230 is in a state loaded on a lower side stopper 410. Thus, the key 100 is stabilized in a rest position. When the key is pressed, the weight portion 230 moves upward and collides with an upper side stopper 430. This defines an end position, which is the maximum key pressing amount of the key 100. The weight 230 also applies a load to the key pressing. The lower side stopper 410 and the upper side stopper 430 are formed with a buffer material or the like (non-woven fabric, an elastic body, or the like).

The sensor 300 is attached to the frame 500 below the load generating portion. When the sensor 300 is pressed against on a contact face 215 side of the hammer side loading portion 210 by key pressing, the sensor 300 outputs a detection signal. Here, the hammer side loading portion 210, the key side loading portion 120, and the sensor 300 are collectively referred to as a switching device 50. The configuration of the switching device 50 will be described in detail below.

1-3. Configuration of Switching Device

Figure 4:
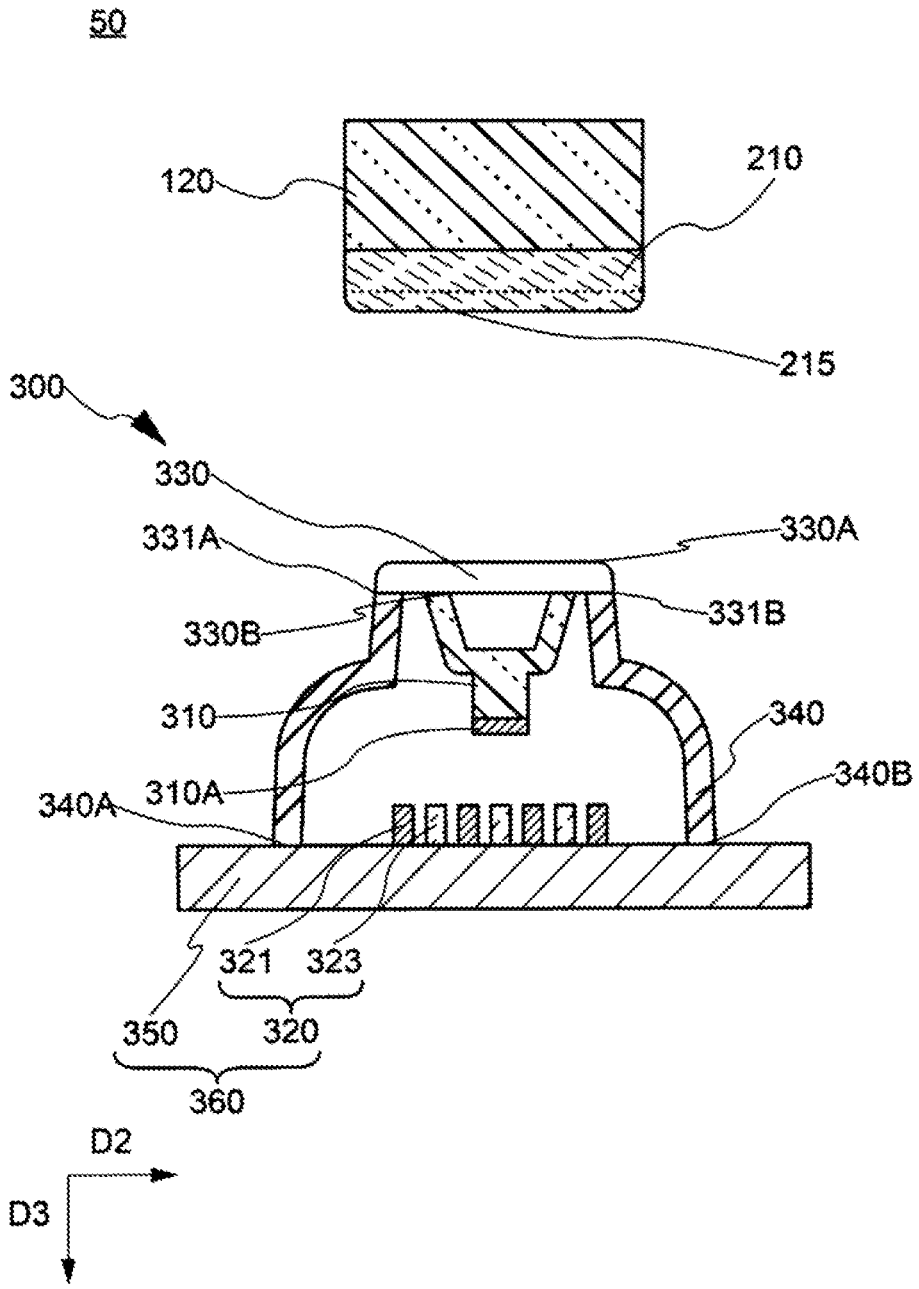
FIG. 4 is an explanatory view of a switching device when viewed from a key front end side in the first embodiment.

FIG. 4 is a cross-sectional view of the switching device 50 of FIG. 3 when viewed from the key front end side (the key front side), that is, when viewed from the direction D1.

The sensor 300 includes an upper electrode 310, a lower electrode 320, an upper electrode support portion 330, a deforming portion 340, and a lower electrode support portion 350.

The upper electrode 310 is provided on a lower face 330B of the upper electrode support portion 330. The upper electrode 310 is formed of an elastic body, and a conductive portion is provided in a tip portion 310A. In this example, molded silicone rubber is used in the upper electrode 310, and conductive carbon black is used as a conductor in the tip portion 310A.

The lower electrode 320 is arranged on an upper face side of the lower electrode support portion 350 so as to face the upper electrode 310. The lower electrode 320 includes a conductor. For example, a metal material such as gold, silver, copper, platinum or the like, or a conductive resin such as conductive carbon black is used in the lower electrode 320.

Note that the lower electrode 320 includes a first lower electrode 321 and a second lower electrode 323. The first lower electrode 321 is connected to a signal line. The second lower electrode 323 is connected to a GND line. When the first lower electrode 321 and the second lower electrode 323 are electrically connected, a detection signal is output. In FIG. 4, the first lower electrode 321 and the second lower electrode 323 are adjacent and alternately arranged.

The deforming portion 340 is arranged so as to connect the upper electrode support portion 330 and the lower electrode support portion 350. The deforming portion 340 is connected to an end portion 331A of the upper electrode support portion 330 and an end portion 331B of the upper electrode support portion 330. Also, the deforming portion 340 may be fixed directly to the lower electrode support portion 350, or may be fixed indirectly. In this example, the deforming portion 340 is directly fixed to the lower electrode support portion 350 by a connecting portion 340A and a connecting portion 340B. In this case, the connecting portion 340A is arranged outside and below the end portion 331A of the upper electrode support portion 330. The connecting portion 340B is also arranged in the same manner. Note that, when the deforming portion 340 is fixed to another member, it does not need to be fixed to the lower electrode support portion 350. In addition, the deforming portion 340 has an elastic force. Thus, the upper electrode 310 and the upper electrode support portion 330 can be moved in the vertical direction. In this case, the distance between the upper electrode 310 and the lower electrode 320 is variable. Also, by having an elastic force, the deforming portion 340 can be restored to its original position when released from pressing force by the hammer side loading portion 210. In this example, molded silicone rubber is used in the deforming portion 340.

The upper electrode support portion 330 is arranged facing the hammer side loading portion 210. In FIG. 4, an upper face 330A of the upper electrode support portion 330 has a flat face. Note that the upper face 330A may have a recess corresponding to the shape of the upper electrode 310. In the upper electrode support portion 330, silicone rubber is used such that the upper electrode support portion 330 can be processed and formed integrated with the upper electrode 310 and the deforming portion 340. Therefore, the upper electrode 310, the upper electrode support portion 330, and the deforming portion 340 can be collectively referred to as a contact member. In a case where these are used as a contact member, the upper electrode support portion 330 may be referred to as an upper face portion of the contact member. Also, the upper electrode support portion 330 may be provided with a lubricant.

The lower electrode support portion 350 is provided as a separate member together with the lower electrode 320. For example, the lower electrode support portion 350 may be provided as a printed circuit board, and the lower electrode 320 may be an electrode formed on the printed circuit board. The lower electrode support portion 350 can also be referred to as a support portion. That is, the lower electrode 320 and the lower electrode support portion 350 can be collectively referred to as a circuit board 360.

The hammer side loading portion 210 has a contact face 215 that contacts the upper electrode support portion 330. The contact face 215 has a flat face. A material harder than the upper electrode support portion 330 is used in the hammer side loading portion 210 including the contact face 215. For example, a material such as plastic is used in the hammer side loading portion 210. The contact face 215 may be provided with a lubricant.

Figure 5:
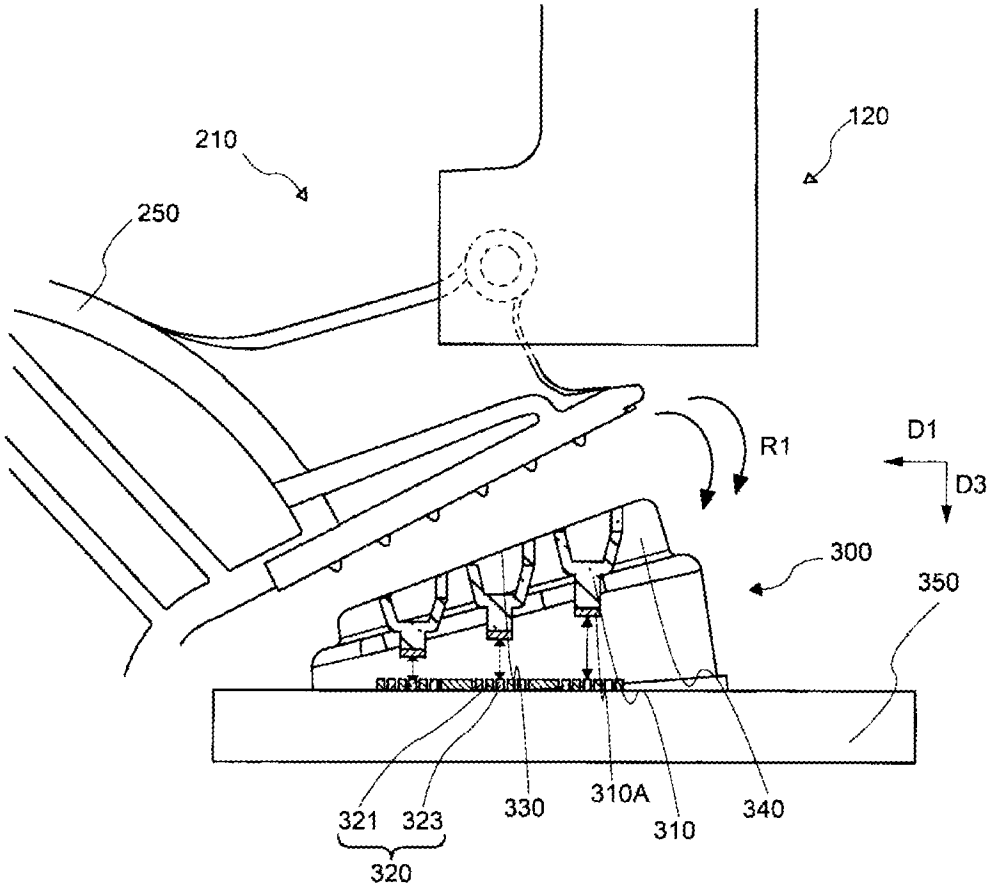
FIG. 5 is an explanatory view of the switching device when viewed from a keyboard side face in the first embodiment.

FIG. 5 is a cross-sectional view of the switching device 50 of FIG. 3 as viewed from the lateral direction (the keyboard scale direction, that is, the direction D2 in FIG. 4) of the keyboard. As shown in FIG. 5, the upper electrode support portion 330 of the sensor 300 is arranged inclined relative to the lower electrode support portion 350, corresponding to a trajectory R1 where the hammer side loading portion 210 rotates. In this example, three of the upper electrodes 310 are arranged. Also, the lower electrode 320 is arranged corresponding to the upper electrodes 310. The three upper electrodes 310 each have a different distance to the lower electrode 320. By connecting at least any of the three upper electrodes 310 to the lower electrode 320, a detection signal is output.

1-4. Configuration of Circuit Board

Figure 6:
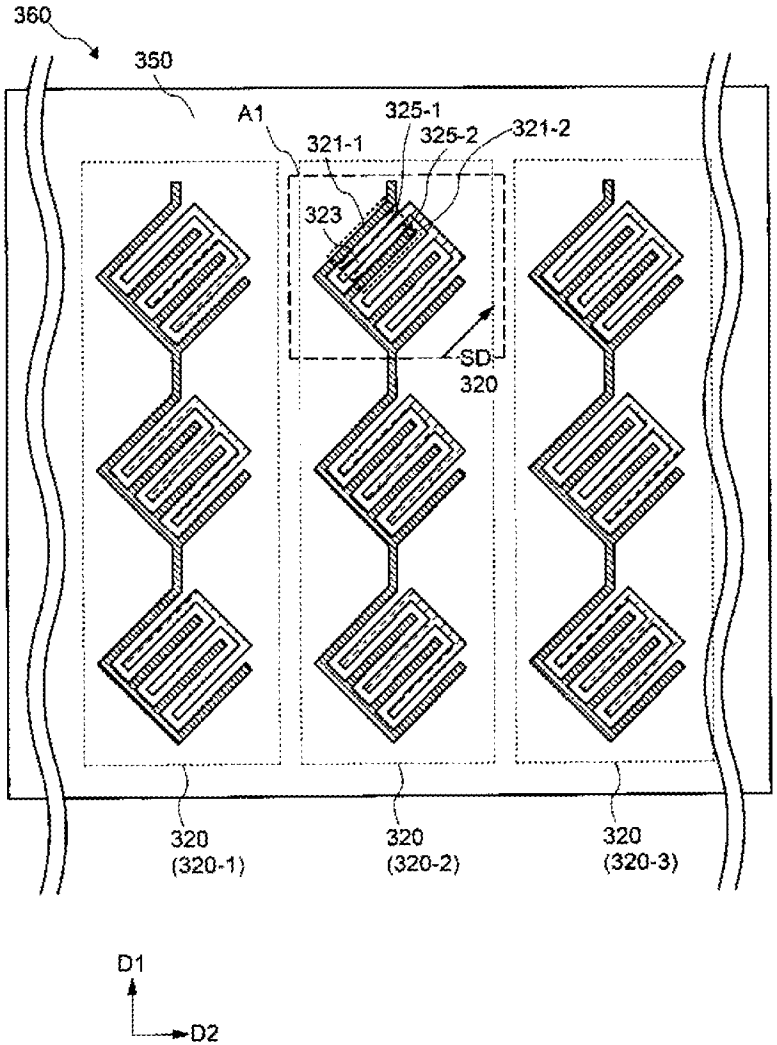
FIG. 6 is a top view of a circuit board in the first embodiment.
Figure 7:
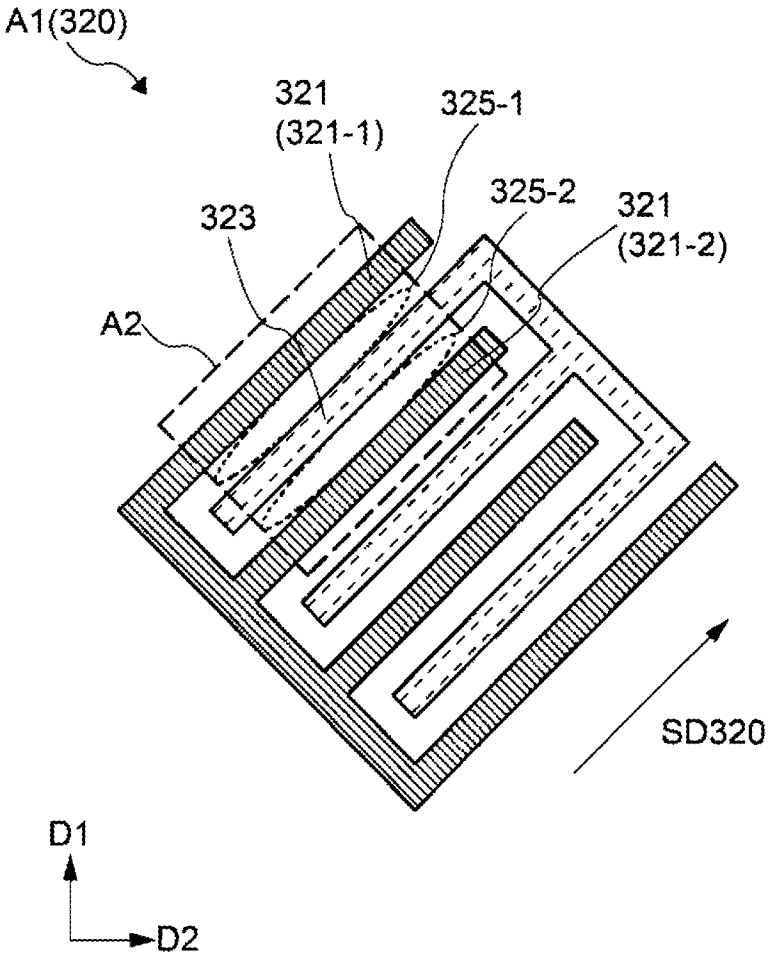
FIG. 7 is a top view of a lower electrode in the first embodiment.

FIG. 6 shows a top view of the circuit board 360. As shown in FIG. 6, in the circuit board 360, a lower electrode 320 is arranged for each key 100, such that a lower electrode 320-1, a lower electrode 320-2, and a lower electrode 320-3 are arranged. FIG. 7 shows an enlarged top view of an area A1 in the lower electrode 320 shown in FIG. 6.

As shown in FIG. 7, the first lower electrodes 321 and the second lower electrodes 323 are adjacent and alternately arranged. Each of the first lower electrodes 321 has a shape connected at one side. Such a shape can be referred to as a comb shape. The second lower electrodes 323 also have a comb shape.

In FIG. 7, when viewing only an area A2, the second lower electrodes 323 are arranged between the plurality of first lower electrodes 321 (the first lower electrode 321-1 and the first lower electrode 321-2) which are adjacently arranged. In this case, the first lower electrode 321-1 and the second lower electrode 323 are insulated by a space 325-1. Similarly, the first lower electrode 322-2 and the second lower electrode 323 are insulated by a space 325-2. In this case, the space 325-1 and the space 325-2 extend longitudinally in a space direction SD320. The space direction SD320 is a direction between the front-rear direction (the direction D1) of the key, and the lateral direction relative to the keyboard (which may be the scale direction of the key 100 and the hammer assembly 200, that is, the direction D2 in FIG. 4). Note that the direction D1 is the same direction as the longitudinal direction of the key. Also, the direction D2 is the same direction as the direction of the rotational shaft 520 described later. The direction D1 is orthogonal to the direction D2.

1-5. Operation of Keyboard Assembly

Figure 8A:
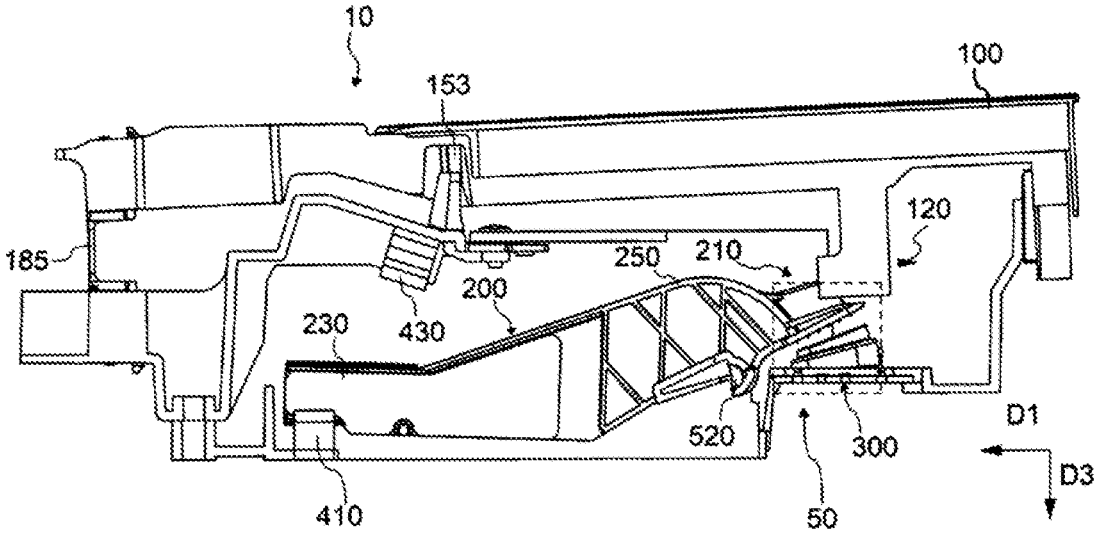
FIGS. 8A and 8B illustrate operation of a key assembly when a key (a white key) is pressed in the first embodiment.
Figure 8B:
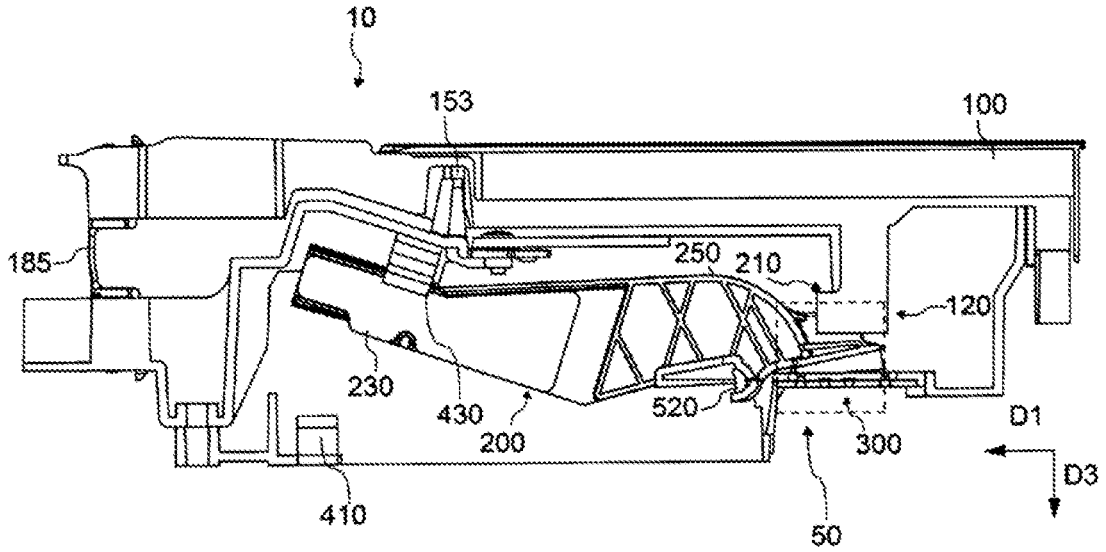

FIGS. 8A and 8B illustrate operation of a key assembly when a key (a white key) is pressed. FIG. 8A shows a case where the key 100 is in the rest position (in a state where the key is not pressed). FIG. 8B shows a case where the key 100 is in the end position (in a state where the key is pressed all the way to the end). When the key 100 is pressed, the rod-like flexible member 185 bends as the center of rotation. At this time, the rod-like flexible member 185 is bent and deformed in the forward direction (front direction) of the key 100, but due to restriction of movement in the front-rear direction by the side face key guide 153, the key 100 rotates in a normal direction (a direction D3) relative to the key 100 rather than moving in the forward direction (the direction D1). Then, when the key side loading portion 120 pushes down the hammer side loading portion 210, the hammer assembly 200 rotates around the rotational shaft 520.

Figure 9:
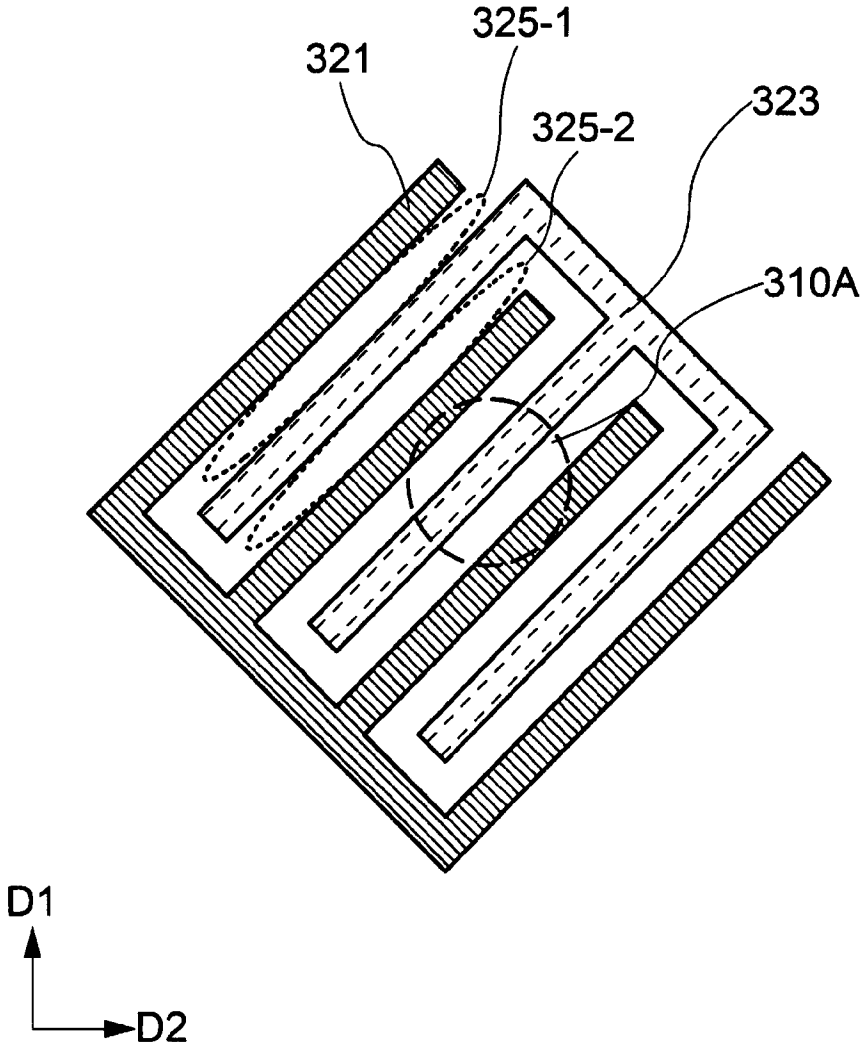
FIG. 9 is a top view of the lower electrode when the key (the white key) is pressed in the first embodiment.

Collision of the weight portion 230 with the upper side stopper 430 stops the rotation of the hammer assembly 200, and the key 100 reaches the end position. In addition, when the sensor 300 is pressed against by the hammer side loading portion 210, the sensor 300 outputs a detection signal at a plurality of steps corresponding to the amount of pressing (the key pressing amount). For example, in the case of FIG. 5, the detection signal may change according to the number of upper electrodes 310 that contact the lower electrode 320. Note that the hammer side loading portion 210 functions as one actuator. In the above description, the actuator can be said to move according to operation of the key 100. FIG. 9 shows a top view of the circuit board 360 when pressed by the hammer side loading portion 210. Further, FIG. 10 shows a cross-sectional view of the switching device 50 when viewed from the key tip direction when pressed by the hammer side loading portion 210.

Figure 10:
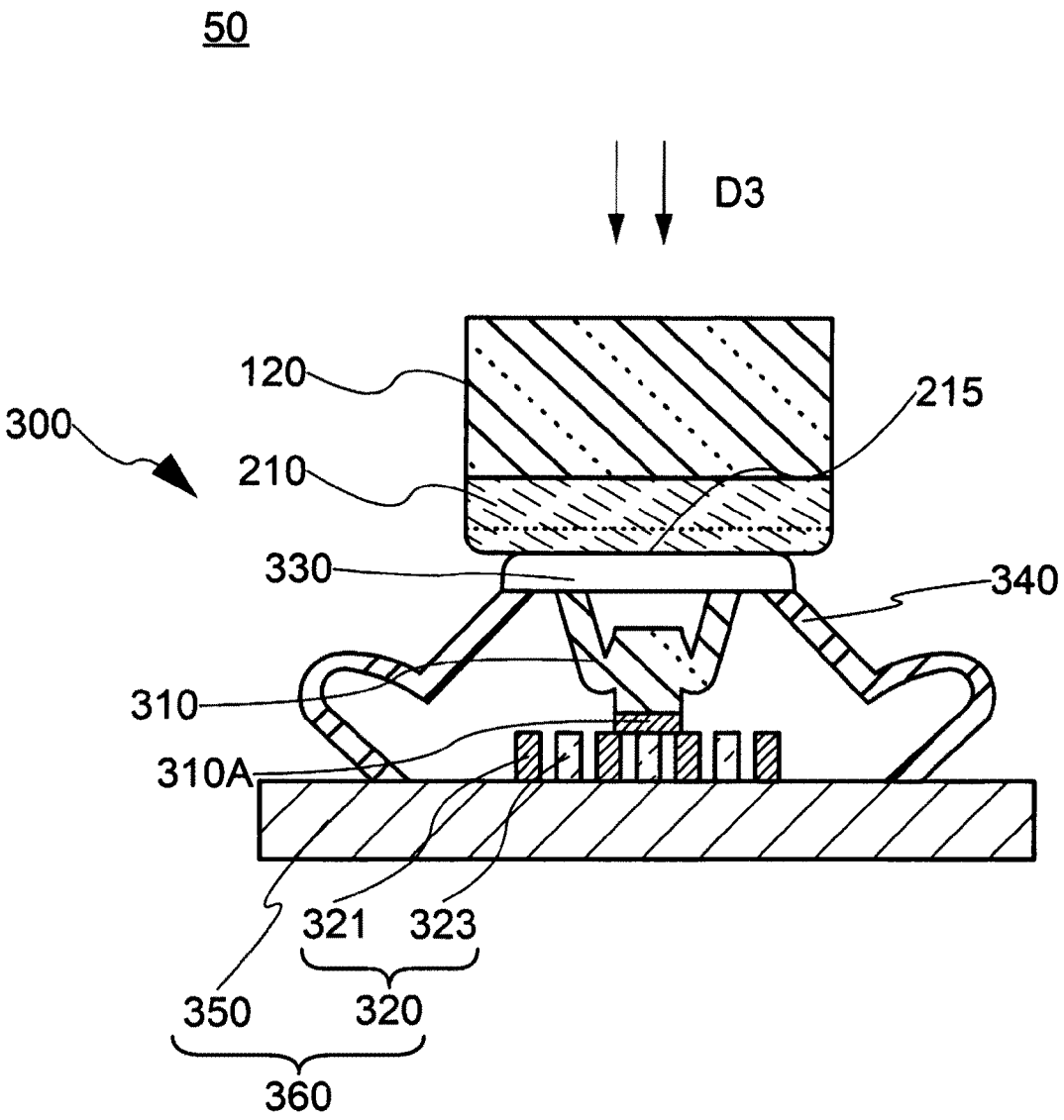
FIG. 10 is an explanatory view of the switching device when viewed from the key front end side when the key (the white key) is pressed in the first embodiment.

As shown in FIGS. 9 and 10, when the upper electrode support portion 330 is pressed in the vertical direction (the direction D3) relative to the lower electrode support portion 350 by the hammer side loading portion 210, the upper electrode 310 and the lower electrode 320 contact each other. In this case, the tip portion 310A of the conductive upper electrode 310 electrically connects the first lower electrode 321 and the second lower electrode 323 according to operation of the actuator (the hammer side loading portion 210). Thus, in the switching device 50, a detection signal is normally output, and a stable sound is generated. However, when a key at a position far from the player is pressed, in a case where vibration (shaking) occurs in the hammer side loading portion 210, or the like, force may also be applied in the scale direction (direction D2) of the key relative to the hammer side loading portion 210. Similarly, when the player strongly presses the key, force may be applied in the longitudinal direction (the direction D1) of the key. Note that the direction D1 or the direction D2 may be a direction in which force is strongly applied by the player.

Figure 20A:
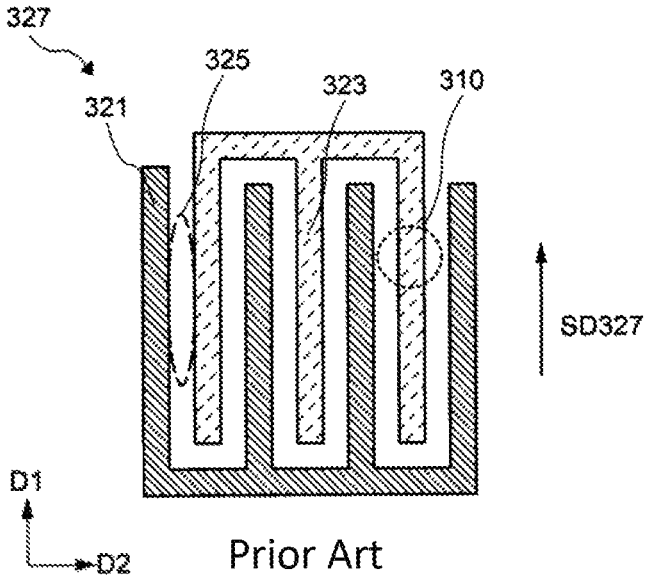
FIGS. 20A and 20B are each a top view of a circuit board when a key (a white key) is pressed in a conventional example.
Figure 20B:
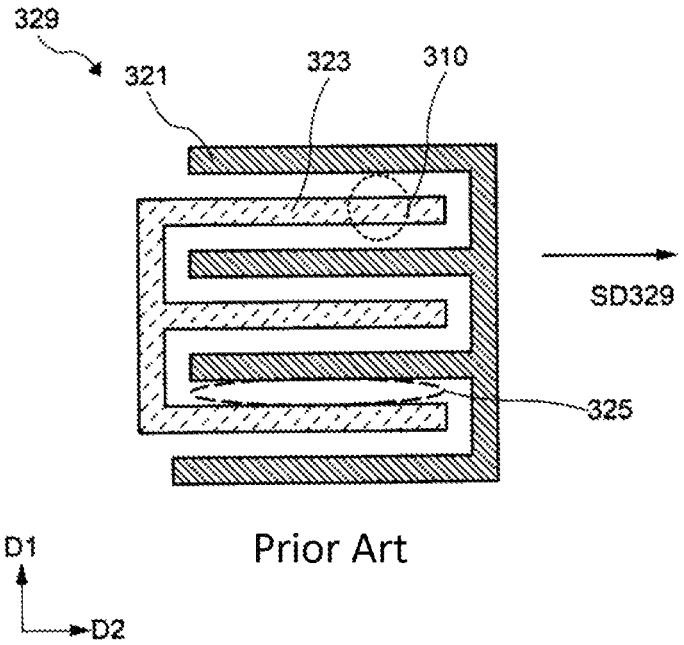
Prior Art Fig.20B

FIGS. 20A and 20B each show, in a conventional example, a top view of the circuit board 360 (particularly a lower electrode 327 and a lower electrode 329) when the upper electrode support portion 330 is pressed in a manner shifted in the front-rear direction (the direction D1) of the key or the scale direction (the direction D2) of the key by the hammer side loading portion 210. In the case of the lower electrode 327 in FIG. 20A, a space direction SD327 of a space 325 is the same as the direction D1. In this case, the circuit board 360 having the lower electrode 327 strongly resists the shift in the direction D1, but is susceptible to the shift in the D2 direction. For example, as shown in FIG. 20A, when the upper electrode 310 is shifted in the direction D2, it may only contact any one of the first lower electrode 321 and the second lower electrode 323. In this case, the first lower electrode 321 and the second lower electrode 323 cannot be electrically connected, and the sensor 300 may not function normally. Similarly, in the case of the lower electrode 329 shown in FIG. 20B, the space direction SD329 of the space 325 is the same as the D2 direction. In this case, the circuit board 360 having the lower electrode 329 strongly resists the shift in the direction D2, but is susceptible to the shift in the direction D1. For example, as shown in FIG. 20B, when the upper electrode 310 is shifted in the direction D1, it may only contact any one of the first lower electrode 321 and the second lower electrode 323. In this case, as in FIG. 20A, the first lower electrode 321 and the second lower electrode 323 cannot be electrically connected, and the sensor 300 may not function normally. In these cases, it can be said that the sensor 300 cannot output a detection signal, and the keyboard device 1 cannot generate sound.

Figure 11:
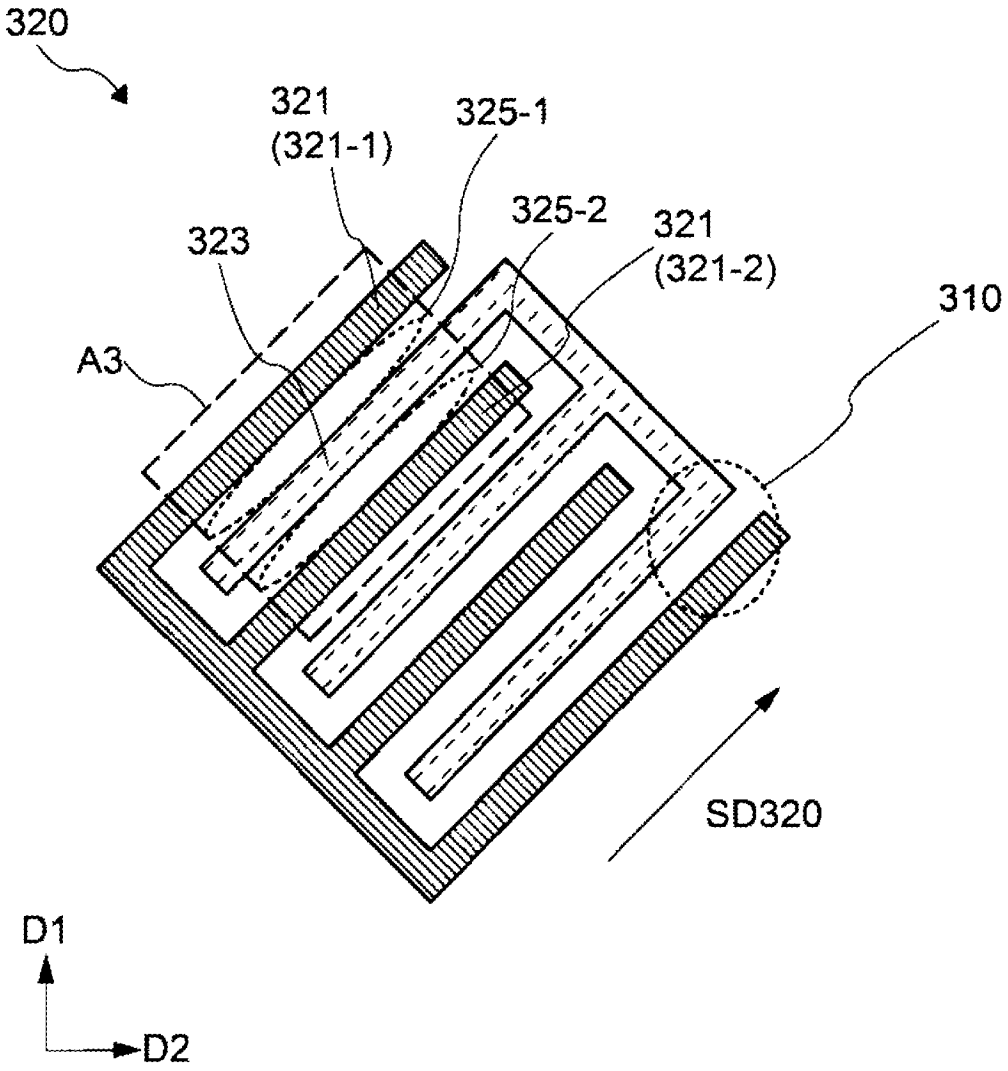
FIG. 11 is a top view of the lower electrode when the key (the white key) is pressed in the first embodiment.

FIG. 11 shows a top view of the circuit board 360 when the upper electrode support portion 330 is pressed in a manner shifted in the scale direction (the direction D2) of the key by the hammer side loading portion 210. Also, FIG. 12 is a cross-sectional view in which the sensor 300 at this time is viewed from the key tip direction.

Figure 12:
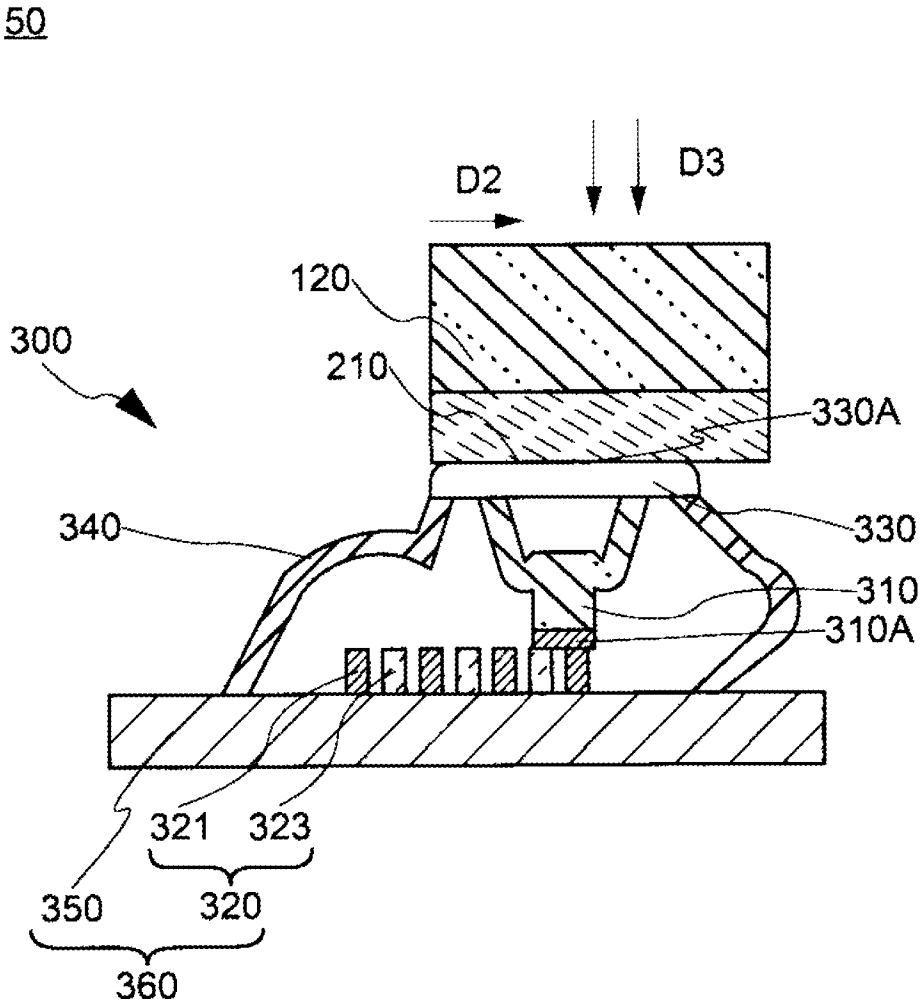
FIG. 12 is an explanatory view of the switching device when viewed from the key front end side when the key (the white key) is pressed in the first embodiment.

As shown in FIGS. 11 and 12, when using this embodiment, the space between the first lower electrode 321 and the second lower electrode 323 has a space direction SD320. Therefore, even when the upper electrode support portion 330 is pressed in a manner shifted in the direction D2 by the hammer side loading portion 210, the tip portion 310A of the upper electrode 310 can contact the first lower electrode 321 and the second lower electrode 323. Also, even when the upper electrode support portion 330 is shifted in the front-rear direction (the direction D1) of the key, the first lower electrode 321 and the second lower electrode 323 can similarly make contact. That is, by using this embodiment, it can be said that the circuit board 360 having the lower electrode 320 strongly resists a shift in any of the directions D1 and D2. Therefore, when the upper electrode support portion 330 is pressed by the hammer side loading portion 210, the first lower electrode 321 and the second lower electrode 323 are electrically connected by the tip portion 310A of the upper electrode 310. Therefore, the sensor 300 can function normally, and can output a detection signal. That is, the keyboard device 1 can stably generate sound.

Note that the space direction SD320 in the first embodiment is preferably inclined 10° to 80° relative to the front-rear direction (the direction D1) of the key, and more preferably is inclined 15° to 75°, and more preferably is inclined 30° to 60°, and more preferably is inclined 40° to 50°, and more preferably is inclined 45°.

Second Embodiment

2. Configuration of Circuit Board

In the second embodiment, a circuit board 360*a* having a shape different from that in the first embodiment will be described.

Figure 13:
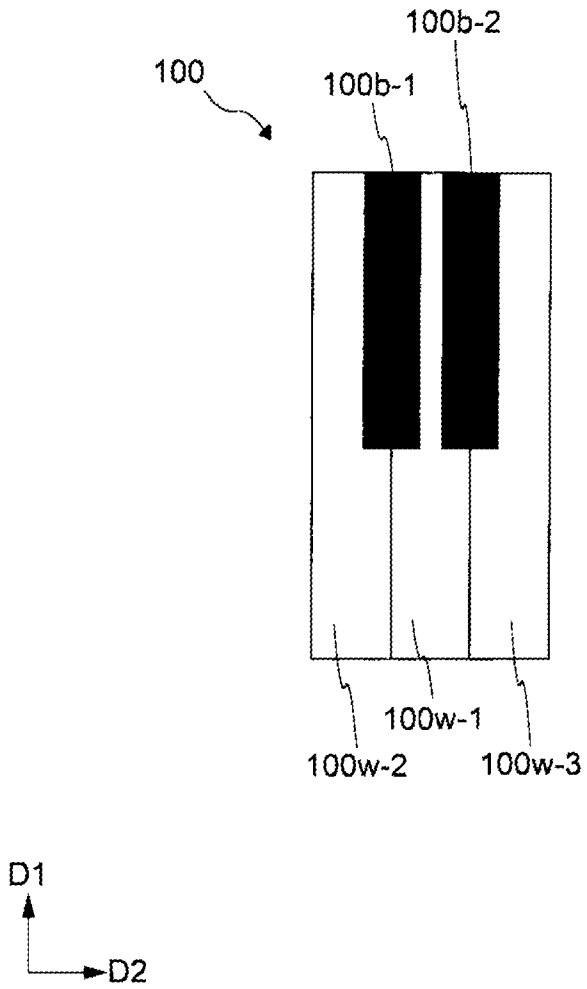
FIG. 13 is a top view showing a partial extraction of a keyboard in a second embodiment.

FIG. 13 is a top view showing a partial extraction of the keyboard device 1. As shown in FIG. 13, in the keyboard device 1, a black key 100*b*-1 and a black key 100*b*-2 are respectively arranged among a white key 100*w*-1, a white key 100*w*-2 and a white key 100*w*-3, and thus the shape of each white key is different. Therefore, the direction of the force applied when the player presses is different for the white key 100*w*-1, the white key 100*w*-2 and the white key 100*w*-3. For example, the shape of the white key 100*w*-1 is symmetrical, so force is easily transmitted in the direction perpendicular to the key. On the other hand, the white key 100*w*-2 has a so-called L-shape in which the upper right portion is notched out. The white key 100*w*-3 has a shape that is symmetrical left-right with the white key 100*w*-2. Therefore, the white key 100*w*-2 and the white key 100*w*-3 are not limited to force being applied only in the vertical direction when pressed by the player, and force may also be applied in the scale direction (the direction D2) of the key.

Figure 14:
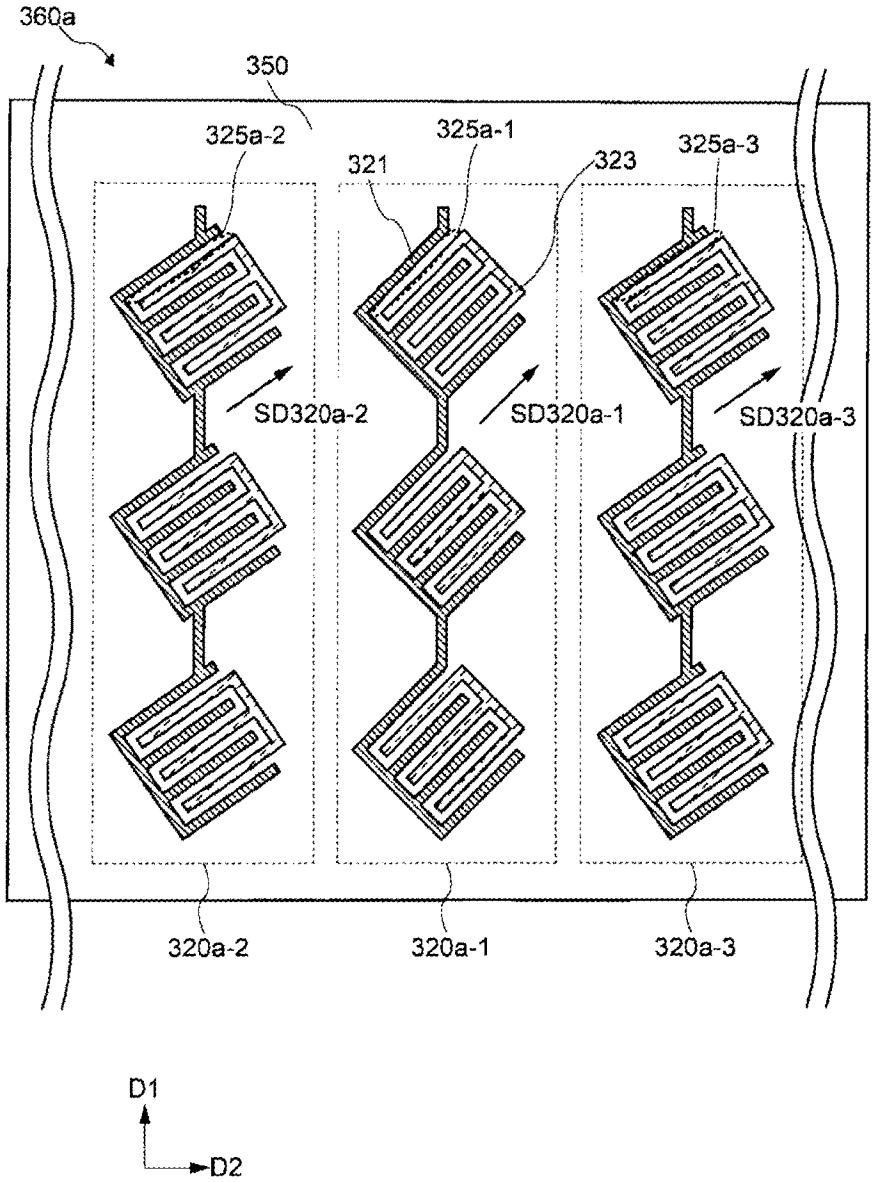
FIG. 14 is a top view of a circuit board in the second embodiment.

The upper face of the circuit board 360*a* is shown in FIG. 14. In FIG. 14, a lower electrode 320*a*-1 is a lower electrode 320*a* corresponding to the white key 100*w*-1. A space 325*a*-1 extends longitudinally in a space direction SD320*a*-1. A lower electrode 320*a*-2 corresponds to the white key 100*w*-2, and a space 325*a*-2 extends longitudinally in a space direction SD320*a*-2. A lower electrode 320*a*-3 corresponds to the white key 100*w*-3, and a space 325*a*-3 extends longitudinally in a space direction SD320*a*-3. In this example, the space direction SD320*a*-2 and the space direction SD320*a*-3 are in the same direction. The space direction SD320*a*-2 and the space direction SD320*a*-3 are closer to the direction D2 than the space direction SD320*a*-1. Thus, even when a force is applied in the scale direction (the direction D2) of the key, the tip portion 310A of the upper electrode 310 can make contact with the first lower electrode 321 and the second lower electrode 323. Therefore, the sensor 300 can stably output a detection signal. That is, the keyboard device 1 can stably generate sound.

Figure 15:
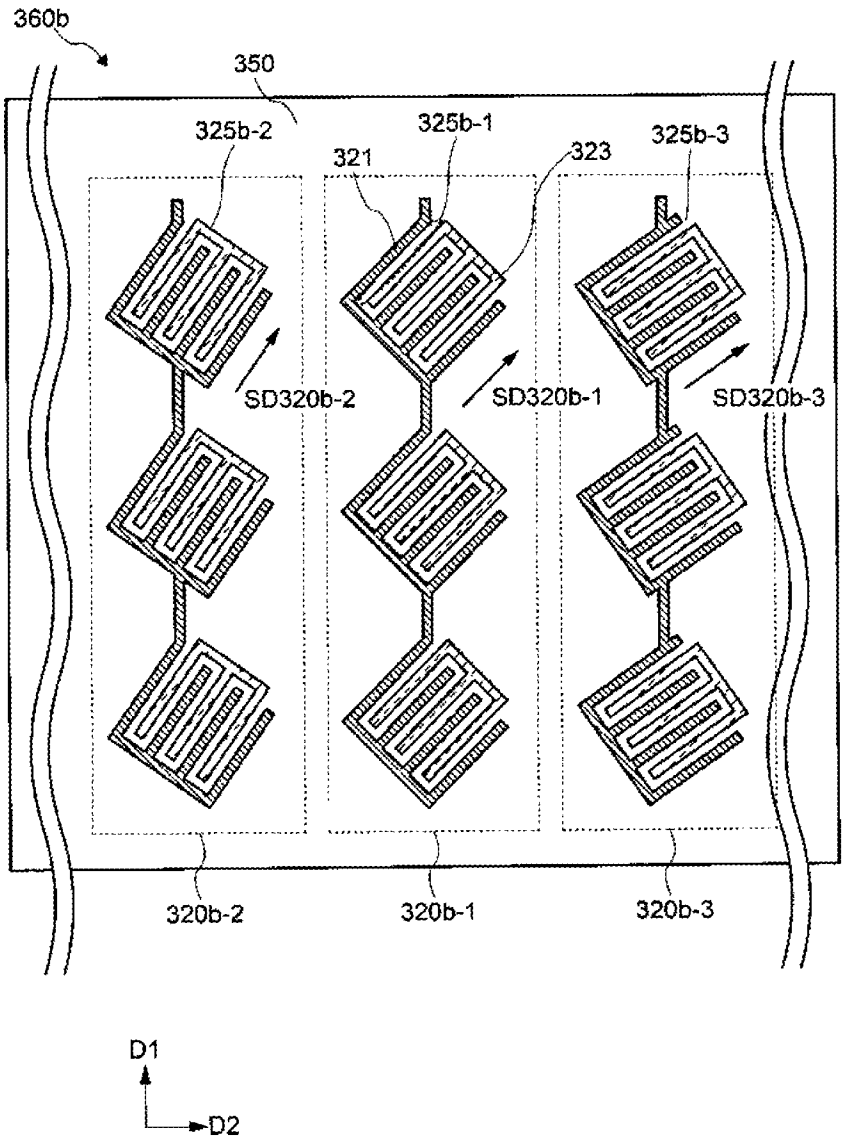
FIG. 15 is a top view of the circuit board in the second embodiment.

Note that the space direction SD320*a*-2 and the space direction SD320*a*-3 may be different depending on the direction in which force is applied. For example, as in the circuit board 360*b* shown in FIG. 15, the space direction SD320*b*-1, the space direction SD320*b*-2, and the space direction SD320*b*-3 each have different directions. In this case, the space direction can be said to be different for each key. The space direction SD320*b*-1, the space direction SD320*b*-2, and the space direction SD320*b*-3 are each a direction between the direction D1 and the direction D2.

Figure 16:
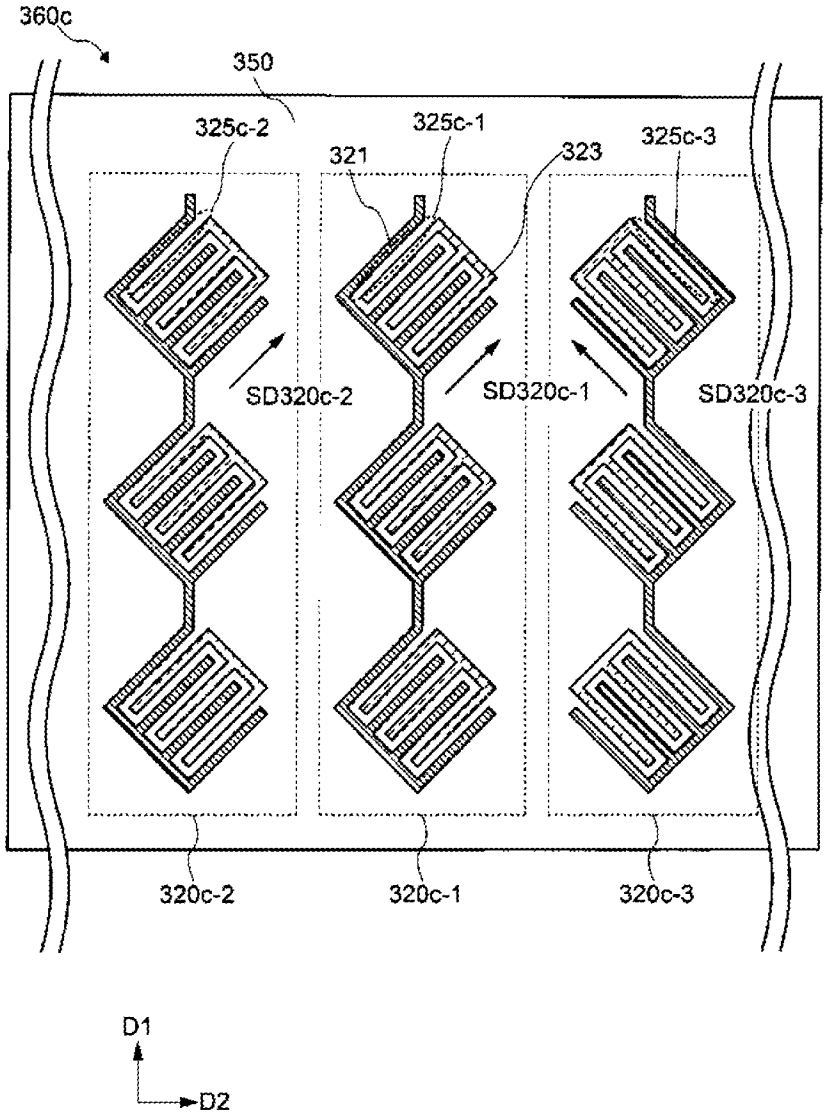
FIG. 16 is a top view of the circuit board in the second embodiment.
Figure 17:
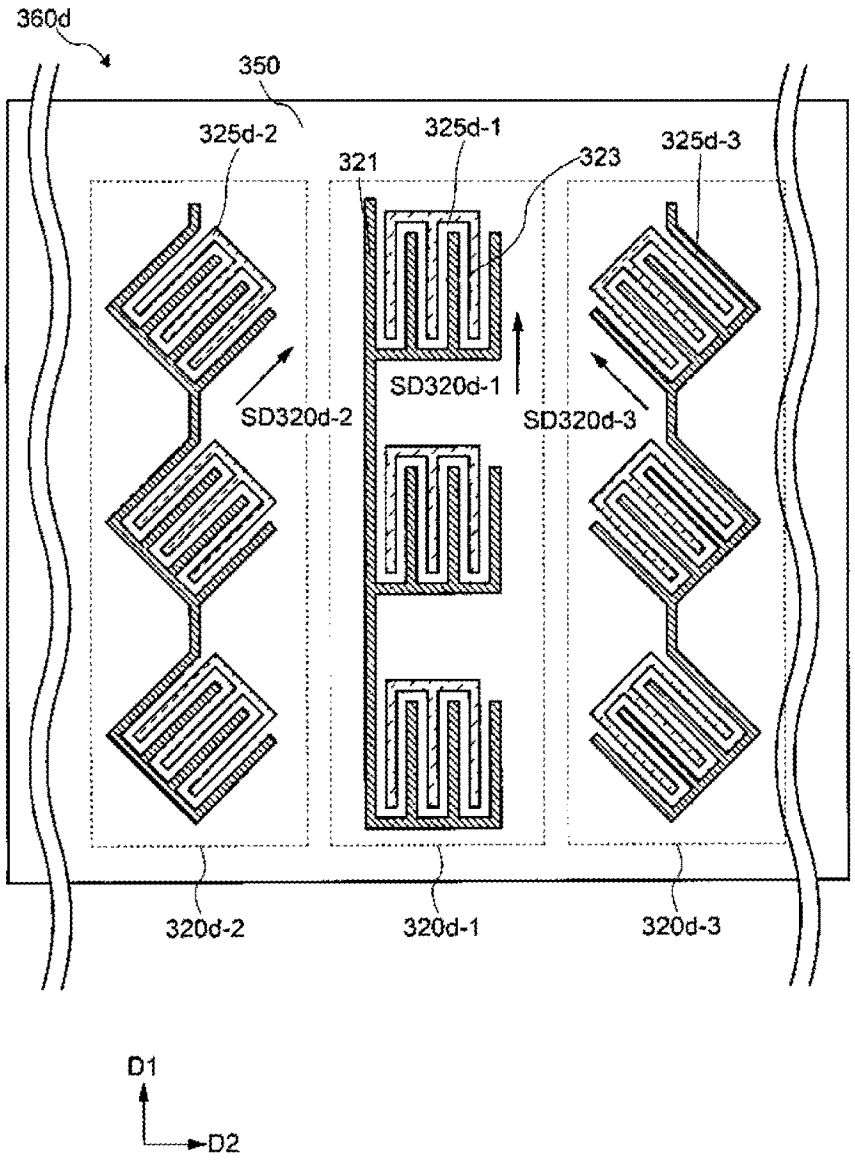
FIG. 17 is a top view of the circuit board in the second embodiment.

Also, the space direction SD320 may differ depending on the left-right direction (pitch of the sound) when the keyboard device 1 is viewed from the player. In the case of the circuit board 360*c* shown in FIG. 16, the space direction is reversed between a bass side and a treble side. In this example, the space direction SD320*c*-1 and the space direction SD320*c*-2 have an upper right direction. On the other hand, the space direction SD320*c*-3 has an upper left direction. Note that when it is easy to apply a force in the longitudinal direction (direction D1) of a key corresponding to the position where the player sits, the space direction SD320*d*-1 may be set to the same direction as the direction D1, as in the circuit board 360*d* shown in FIG. 17. By adopting this sort of configuration, the tip portion 310A of the upper electrode 310, in the circuit board 360, can make contact with the first lower electrode 321 and the second lower electrode 323. Thus, the sensor 300 can stably output a detection signal. That is, the keyboard device 1 can stably generate sound.

As described above, in the second embodiment, the inclination angle of the space direction SD320 relative to the front-rear direction (the direction D1) of the key 100 differs depending on the key 100. In the second embodiment, it possible to mix lower electrodes 320 falling within two or more ranges selected from a group consisting of such an inclination angle of 0° to 10° (not including)10°, 10° to 15° (not including)15°, 15° to 30° (not including)30°, 30° to 40° (not including)40°, 40° to 50° (not including) 50°, 50° to 60° (not including)60°, 60° to 75° (not including)75°, 75° to 80° (not including)80°, and 80° to 90°.

Variations

Although one embodiment of the present invention was described above, this invention can also be implemented in various modes, such as those described below.

In the first embodiment of the present invention, an example was described in which the hammer side loading portion 210 makes contact, but a configuration may also be adopted in which the key side loading portion 120 directly contacts the upper electrode support portion 330, and may be pressed. In this case, the arrangement of the sensor 300 is different from the position shown in FIG. 3, and the sensor 300 is arranged immediately below the key 100 (for example, in FIG. 3, at an intermediate position of a line joining the front end key guide 151 and the side face key guide 153). In this case, the key 100 is connected to the hammer assembly 200 at a position different from the position shown in FIG. 3. The key side loading portion 120 is directly affected by the player's key pressing, so the upper electrode support portion 330 is more easily shifted in the scale direction. Therefore, the effects of using the present invention can be further obtained. Also, in this case, it is not necessary to provide the hammer assembly 200.

Figure 18:
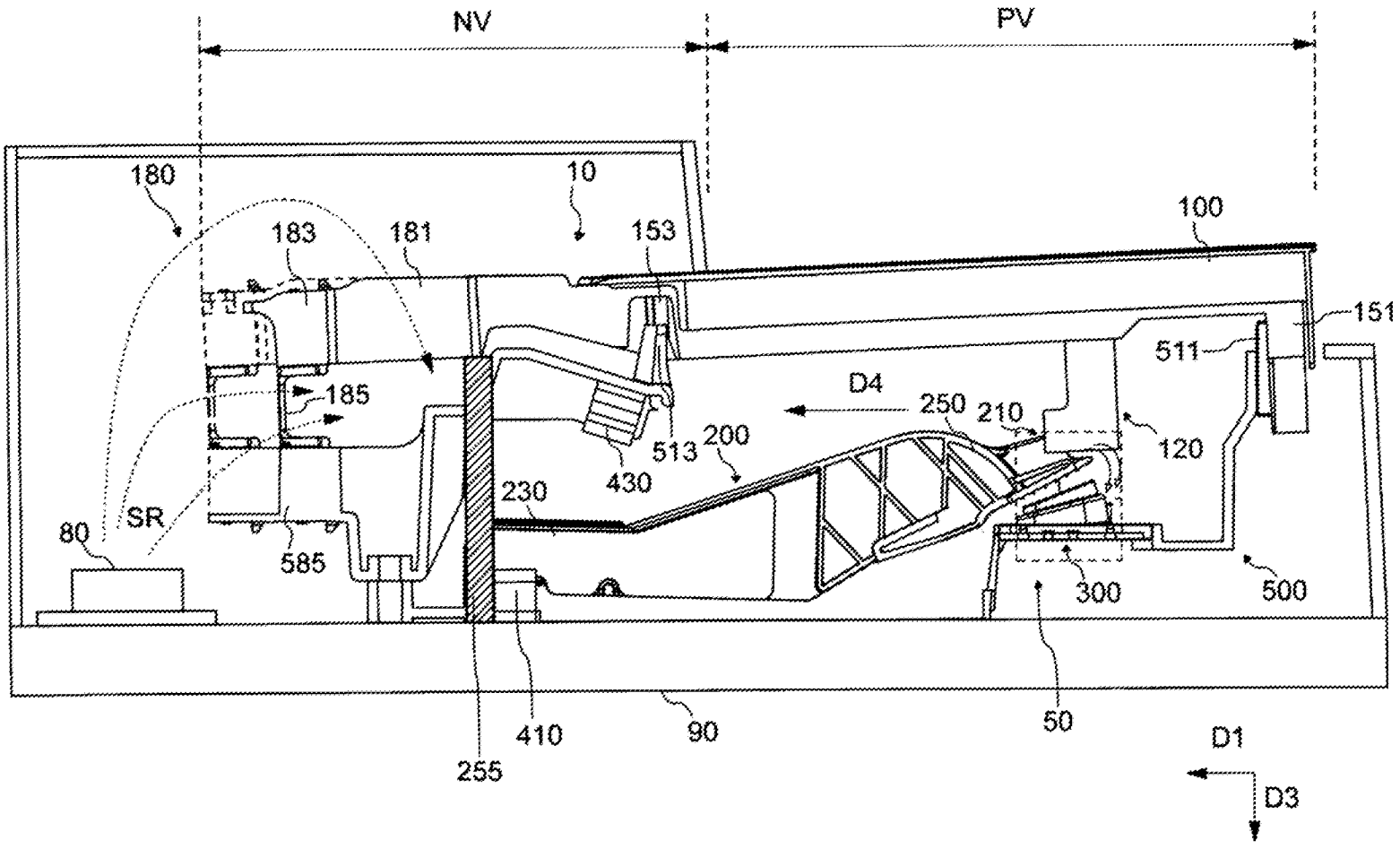
FIG. 18 is an explanatory view of the configuration inside a case in a variation of the first embodiment, viewed from a keyboard side face.

In the first embodiment of the present invention, an example is described in which the hammer assembly 200 rotates around the rotational shaft 520, but the present invention is not limited to this example. As shown in FIG. 18, the hammer assembly 200 may have a flexible portion 255 instead of the rotational shaft 520. The hammer side loading portion 210 is arranged facing the flexible portion 255, and functions as a tip portion of the actuator. The flexible portion 255 interlocks and bends when the rod-shaped flexible member 185 bends. The hammer side loading portion 210 operates with the flexible portion 255 as an axis. In this case, the direction (referred to as a direction D4) connecting the flexible portion 255 and the hammer side loading portion 210 is the same direction as the direction D1. A certain direction orthogonal to the direction D4 is the same as the direction D2. In this case, the space direction SD320 is a direction between the direction D4 and the direction (the same direction as the direction D2) orthogonal to the direction D4. Note that the key side loading portion 120 and the plate-shaped flexible member 181 may be used to configure the actuator. In this case, a configuration may be adopted in which the key side loading portion 120 operates with the plate-like flexible member 181 as an axis to press the upper electrode support portion 330.

In the second embodiment of the present invention, an example is described in which the space direction SD320 of the space 325 is different for each white key 100*w*, but the same is also applicable to the black keys 100*b*. That is, the space direction SD320 of the space 325 may be different for each black key 100*b*.

In the first embodiment of the present invention, an example is described in which the upper electrode support portion 330 is shifted in the longitudinal direction (the direction D1) of the key and in the scale direction (the direction D2) of the key, but the present invention is also applicable when the upper electrode support portion 330 is shifted in an oblique direction, and furthermore is also applicable when the hammer side loading portion 210 is rotated and twisted.

Figure 19:
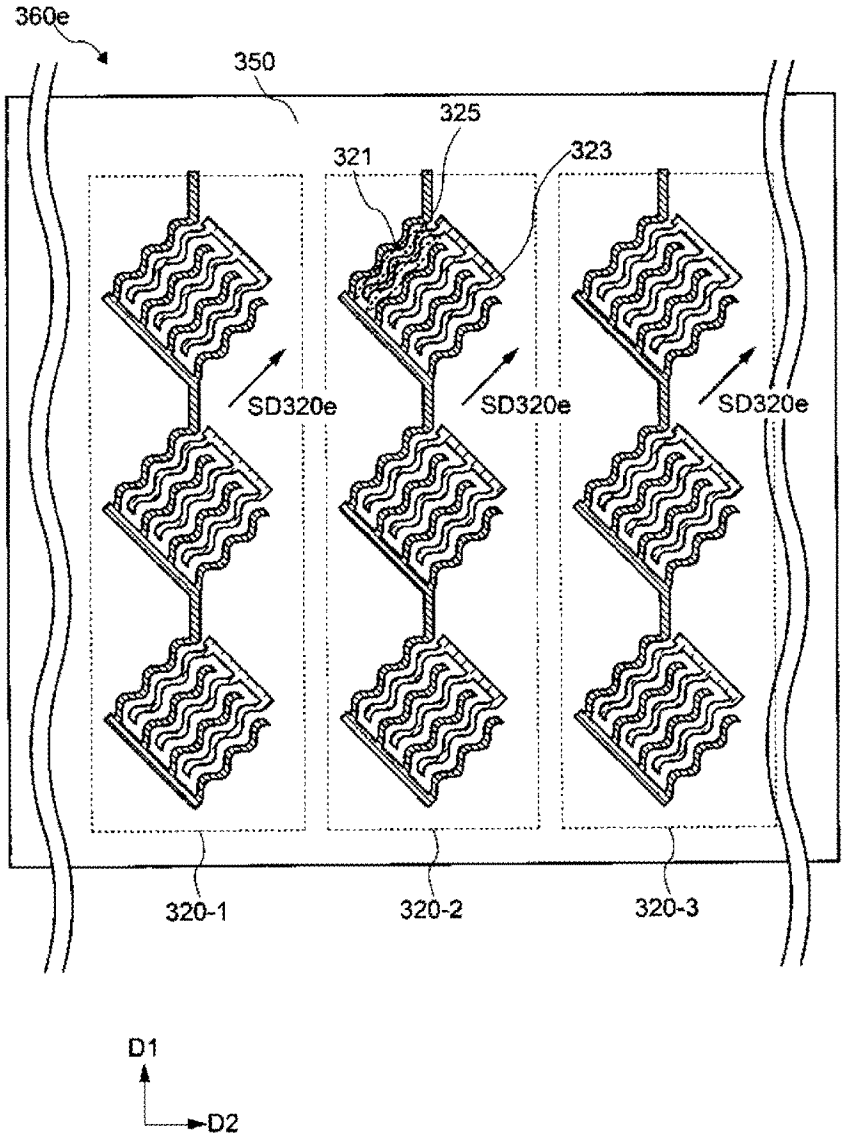
FIG. 19 is a top view of a variation of the circuit board in the first embodiment.

In the first and second embodiments of the present invention, the space 325 is provided in a rectangular shape, but this is not a limitation. For example, as shown in FIG. 19, the first lower electrode 321, the second lower electrode 323, and the space 325 may have a wavy shape. By having this shape, the tip portion 310A of the upper electrode 310 can more effectively make contact with the first lower electrode 321 and the second lower electrode 323. Note that the space 325 also may partially have an arc.

Also, although a keyboard device is described as an example in the first and second embodiments of the present invention, this is not a limitation. The switching device described in the first and second embodiments is also applicable to, other than a keyboard device, a device that performs a pressing operation (for example, such as electronic drums).

LIST OF REFERENCE NUMERALS

1 Keyboard device
10 Keyboard assembly
50 Switching device
70 Sound source device
80 Speaker
90 Case
100 Key
120 Key side loading portion
151 Front end key guide
153 Side face key guide
180 Connecting portion
181 Plate-like flexible member
183 Key side support portion
185 Rod-like flexible member
200 Hammer assembly
210 Hammer side loading portion
215 Contact face
220 Shaft support portion
230 Weight portion
250 Hammer main body
300 Sensor
310 Upper electrode
310A Tip portion
320 Lower electrode
321 First lower electrode
323 Second lower electrode
325 Space
327 Lower electrode
329 Lower electrode
330 Upper electrode support portion
340 Deforming portion
350 Lower electrode support portion
360 Circuit board
410 Lower side stopper
430 Upper side stopper
500 Frame
511 Front end frame guide
513 Side face frame guide
520 Rotational shaft
585 Frame side support portion
710 Signal conversion unit
730 Sound source unit
750 Output unit

The invention claimed is:

1. A switching device for an electronic musical instrument, the switching device comprising:
a plurality of first electrodes that are adjacently arranged along a horizontal plane;
a second electrode arranged between a pair of the plurality of first electrodes, and insulated from the plurality of first electrodes by a plurality of spaces;
a shaft;
a rotatable actuator rotatable about the shaft; and
a conductive member configured to electrically connect the first electrodes and the second electrode, which moves vertically according to rotation of the rotatable actuator,
wherein the plurality of spaces extend longitudinally in a first direction, which is between a longitudinal shaft direction of the shaft and a direction orthogonal to the longitudinal shaft direction, and
wherein the longitudinal shaft direction and the direction orthogonal to the longitudinal shaft direction are parallel to the horizontal plane.

2. The switching device according to claim 1, wherein the first direction is inclined 10° to 80° relative to the direction orthogonal to the longitudinal shaft direction.

3. The switching device according to claim 1, wherein:
the electronic musical instrument is a keyboard device with keys, and
the rotatable actuator is configured to operate according to operation of the keys.

4. The switching device according to claim 3, wherein:
the keys include white keys with different shapes and black keys, and
the first direction differs depending on the shapes of the white keys.

5. The switching device according to claim 3, wherein the first direction is inclined 10° to 80° relative to the direction orthogonal to the longitudinal shaft direction.

6. The switching device according to claim 5, wherein the rotatable actuator extends longitudinally in the direction orthogonal to the longitudinal shaft direction.

7. The switching device according to claim 3, wherein the rotatable actuator extends longitudinally in the direction orthogonal to the longitudinal shaft direction.

8. The switching device according to claim 7, wherein the first direction differs depending on the keys.

9. The switching device according to claim 7, wherein the first direction differs depending on the pitches of sound generated by pressing the keys.

10. The switching device according to claim 7, wherein:
the keys include white keys with different shapes and black keys, and
the first direction differs depending on the shapes of the white keys.

11. The switching device according to claim 3, wherein the first direction differs depending on the keys.

12. The switching device according to claim 11, wherein the first direction differs depending on the pitches of sound generated by pressing the keys.

13. The switching device according to claim 11, wherein:

the keys include white keys with different shapes and black keys, and the first direction differs depending on the shapes of the white keys.

14. The switching device according to claim 3, wherein the first direction differs depending on the pitches of sound generated by pressing the keys.

15. The switching device according to claim 14, wherein:

the keys include white keys with different shapes and black keys, and the first direction differs depending on the shapes of the white keys.

16. A switching device for a keyboard device, the switching device comprising:

keys;

a plurality of first electrodes that are adjacently arranged along a horizontal plane;

a second electrode arranged between a pair of the plurality of first electrodes, and insulated from the plurality of first electrodes by a plurality of spaces;

an actuator configured to operate according to pressing of the keys; and a conductive member configured to electrically connect the first electrodes and the second electrode, which moves vertically according to operation of the actuator, wherein the plurality of spaces extend longitudinally in a first direction, which is between a scale direction of the keys and a longitudinal direction of the keys, and wherein the scale direction of the keys and the longitudinal direction of the keys are parallel to the horizontal plane.

17. The switching device according to claim 16, wherein the first direction is inclined 10° to 80° relative to the longitudinal direction of the keys.

18. A switching device for an electronic musical instrument, the switching device comprising:

a plurality of first electrodes that are adjacently arranged along a horizontal plane;

a second electrode arranged between a pair of the plurality of first electrodes, and insulated from the plurality of first electrodes by a plurality of spaces;

a rotatable actuator; and a conductive member configured to electrically connect the first electrodes and the second electrode, which moves vertically according to rotation of the rotatable actuator, wherein the plurality of spaces extend longitudinally in a first direction, wherein the rotatable actuator includes a flexible portion and a tip portion arranged facing the flexible portion, wherein the tip portion is configured to operate the flexible portion as a shaft, wherein the first direction is between a second direction that joins the flexible portion and the tip portion and a third direction orthogonal to the second direction, and wherein the second direction and the third direction are parallel to the horizontal plane.

19. The switching device according to claim 18, wherein the first direction is inclined 10° to 80° relative to the second direction.

* * * * *